US005388813A

United States Patent [19]

Arsenault

[11] Patent Number: 5,388,813

[45] Date of Patent: Feb. 14, 1995

[54] CEILING CLAMP

[76] Inventor: Cyrus L. Arsenault, 90 Jennings Ave., Bridgeport, Conn. 06610

[21] Appl. No.: 140,442

[22] Filed: Oct. 25, 1993

[51] Int. Cl.[6] ..... B25B 1/02

[52] U.S. Cl. ..... 269/41; 269/98; 269/155; 269/282; 269/904

[58] Field of Search ..... 269/41, 97, 98, 155, 269/154, 904, 282, 257, 53, 54.5

[56] References Cited

U.S. PATENT DOCUMENTS

| | | | |
|---|---|---|---|
| 1,161,593 | 11/1915 | Bever | 269/98 |
| 1,412,961 | 4/1922 | Periolat | 269/282 |
| 1,500,795 | 7/1924 | Bramhorst | 269/98 |
| 2,636,527 | 4/1953 | Schlemann | 269/97 |
| 2,770,271 | 11/1956 | Kane . | |
| 3,017,174 | 1/1962 | Reuter . | |
| 3,854,712 | 12/1974 | McGee | 269/97 |
| 3,914,871 | 10/1975 | Wolff | 269/41 |
| 3,953,015 | 4/1976 | Taylor et al. . | |
| 4,002,328 | 1/1977 | Wolf et al. | 269/97 |
| 4,256,295 | 3/1981 | Egner | 269/97 |
| 4,522,379 | 6/1985 | Lindgren | 269/97 |
| 4,709,460 | 12/1987 | Luhowyj . | |
| 4,786,038 | 11/1988 | Ammons . | |
| 4,836,517 | 6/1989 | Vossler . | |

*Primary Examiner*—Robert C. Watson
*Attorney, Agent, or Firm*—John H. Crozier

[57] ABSTRACT

In a preferred embodiment, a ceiling clamp to assist in mounting panels to a ceiling, including: an upwardly open channel defined by a distal vertical wall, an upper portion of a proximal vertical wall parallel to the distal vertical wall, and a horizontal floor joining the distal and proximal walls, the upwardly open channel being dimensioned to accommodate therein a lower portion of a ceiling joist; clamping means to clamp the lower portion of the ceiling joist in the upwardly open channel; and a horizontal base member attached to the upwardly open channel to provide a surface upon which an end or edge of ceiling panel may be placed when the ceiling clamp is clamped to the ceiling joist.

6 Claims, 3 Drawing Sheets

CEILING CLAMP

BACKGROUND OF THE INVENTION

1. Field of the Invention

The present invention relates to construction tools generally and, more particularly, but not by way of limitation, to a novel clamp to assist in mounting building materials to ceiling or wall framing members.

2. Background Art

When installing building materials, such as sheetrock panels, overhead or on walls, it usually necessary to have two workers place each panel in place and hold it there while one or both of the workers nails, or otherwise secures, the panel to the structural framing members. If one worker is alone, he may rely on various types of props to hold one end of the panel while he begins to nail the other end of the panel.

Some attempts have been made to provide tools to assist in mounting construction materials in such situations:

For example, U.S. Pat. No. 2,770,271, issued Nov. 13, 1956, to Kane, describes a carpenter's board holding bracket for assisting in attaching sheathing to joists or studs which includes an inverted U-shaped portion which fits over the edge of the joist or stud opposite to the edge to which the sheathing is being attached.

For another example, U.S. Pat. No. 3,953,015, issued Apr. 27, 1976, to Taylor et al., describes a ceiling hanger which includes a horizontal base plate, on which an edge of wallboard can be placed, depending from an inverted U-shaped portion which fits over the top edge of a joist.

A substantial disadvantage of both of the above tools is that neither can be employed when there is material already installed on top of the joist or on the rear of the studs.

Accordingly, it is a principal object of the present invention to provide a ceiling clamp to assist in the installation of building materials on joists or studs which clamp can be employed when other material is already installed on top of the joists or at the rear of the studs.

It is a further object of the invention to provide such a clamp which is easy to use.

It if an additional object of the invention to provide such a clamp which is economical to construct.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a ceiling clamp to assist in mounting panels to a ceiling, comprising: an upwardly open channel defined by a distal vertical wall, an upper portion of a proximal vertical wall parallel to said distal vertical wall, and a horizontal floor joining said distal and proximal walls, said upwardly open channel being dimensioned to accommodate therein a lower portion of a ceiling joist; clamping means to clamp said lower portion of said ceiling joist in said upwardly open channel; and a horizontal base member attached to said upwardly open channel to provide a surface upon which an end or edge of ceiling panel may be placed when said ceiling clamp is clamped to said ceiling joist.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
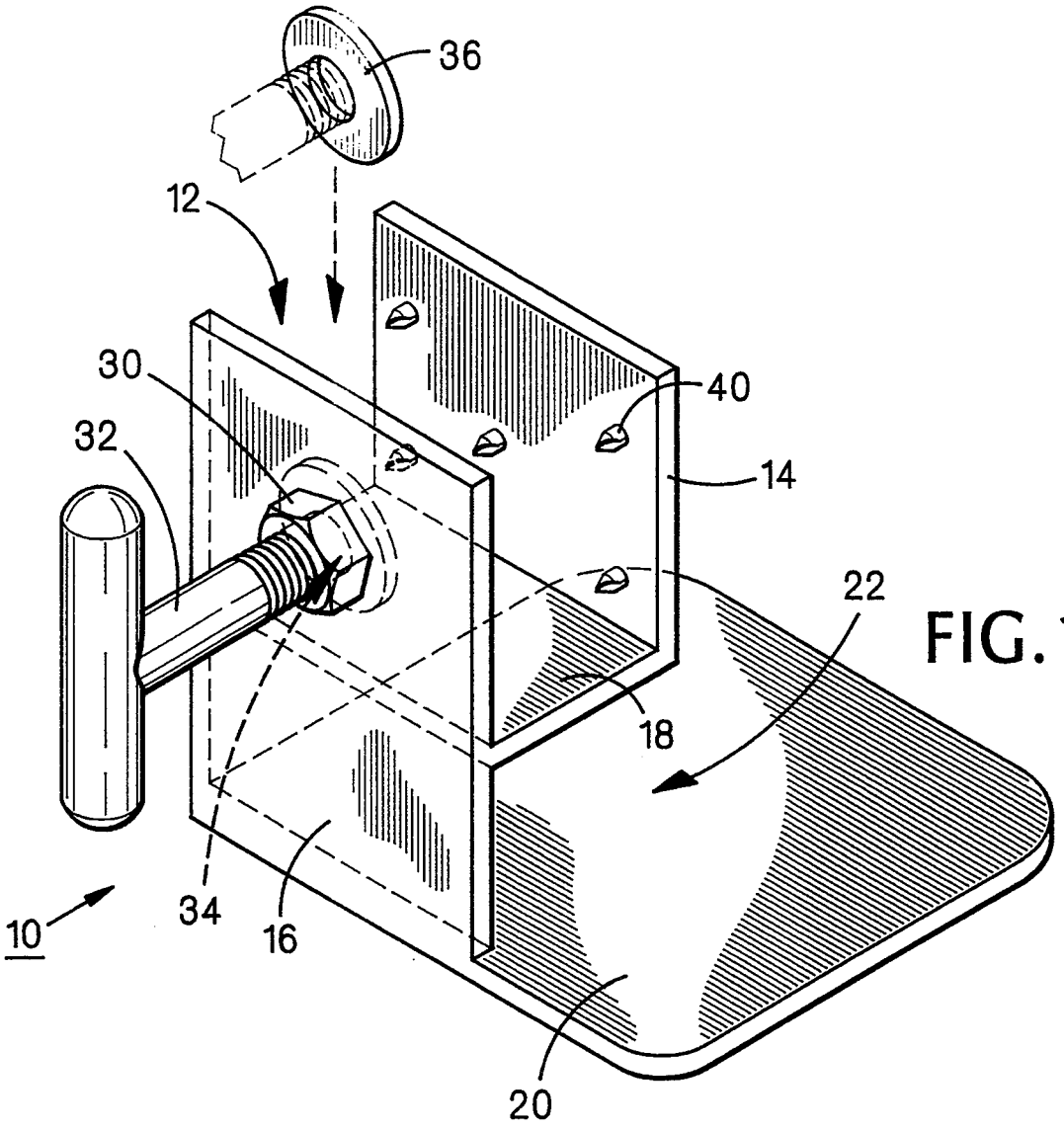
FIG. 1 is an isometric view of a ceiling clamp constructed according to the present invention.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

Figure 2:
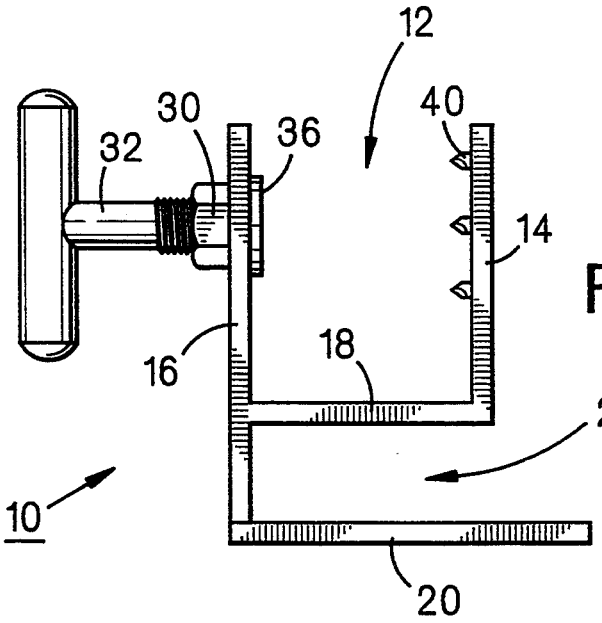
FIG. 2 is an end elevational view of the ceiling clamp of FIG. 1.

Reference should initially be made to FIGS. 1 and 2 together for an understanding of the construction of the ceiling clamp of the present invention, generally indicated by the reference numeral 10.

Ceiling clamp 10 includes a upwardly open, rectilinear channel 12 defined by a distal vertical wall 14, an upper portion of a proximal vertical wall 16, parallel to the distal vertical wall, and a horizontal floor 18 joining the distal and proximal walls. Joined to the lower edge of proximal wall 16 is a horizontal base member 20 parallel to, and spaced apart from the lower surface of floor 18, the base member extending horizontally outwardly of distal wall 14 and extending horizontally outwardly of an end of channel 12. Base member 20, floor 18, and a lower portion of proximal wall 16 define a sidewardly open, rectilinear channel 22.

Figure 6:
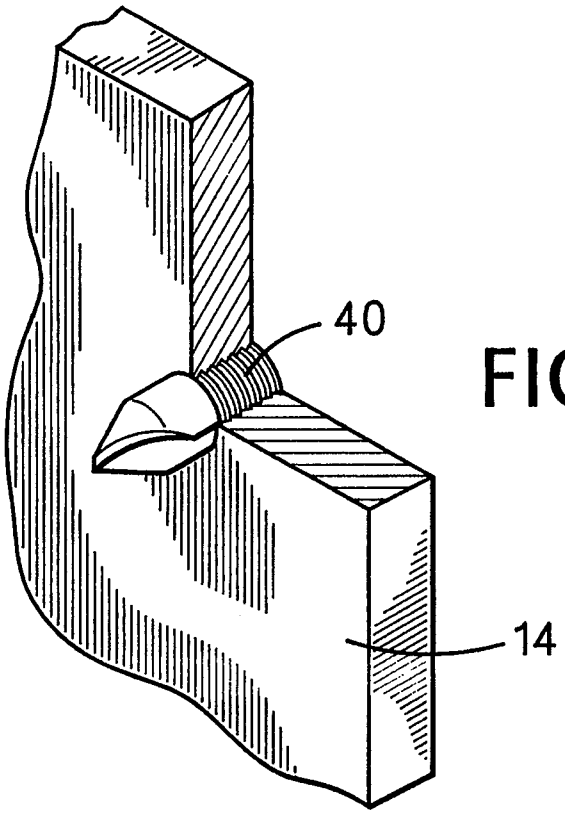
FIG. 6 is a fragmentary isometric view taken along line "6—6" of FIG. 5.
Figure 5:
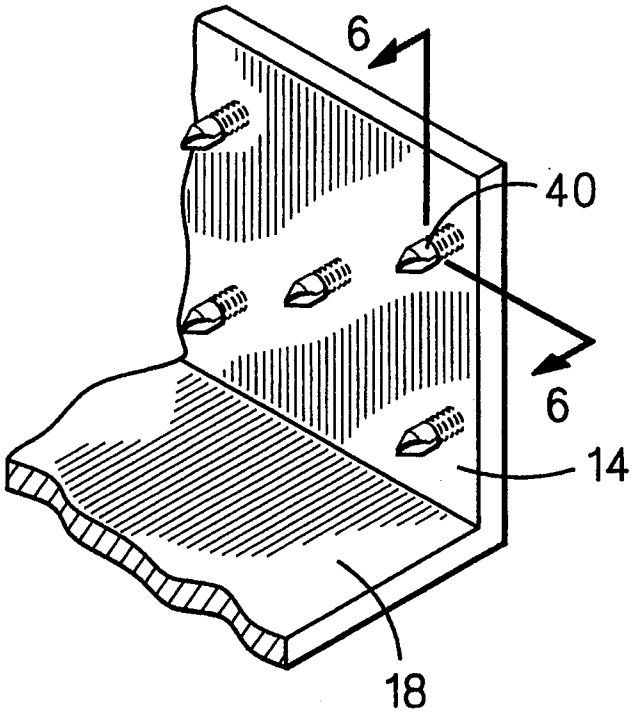
FIG. 5 is a fragmentary isometric view of the ceiling clamp of the present invention.

A nut 30 is welded to the outer surface of proximal wall 16 and a T-handle 32 has a threaded portion which threadingly engages nut 30 so as to advance through an opening 34 (FIG. 1) defined through the proximal wall into channel 12. Welded to the distal end of the threaded portion of T-handle 32 is a washer 36. A plurality of sharp points, as at 40, extends into channel 12 from the inner surface of distal wall 14. Sharp points 40 may be the tips of self-tapping screws extending through distal wall 14. FIGS. 5 and 6 illustrate more clearly the insertion of the tips of self-tapping screws 40 through distal wall 14. It can be seen that channel 12 and T-handle 32 together comprise a clamping mechanism.

Figure 3:
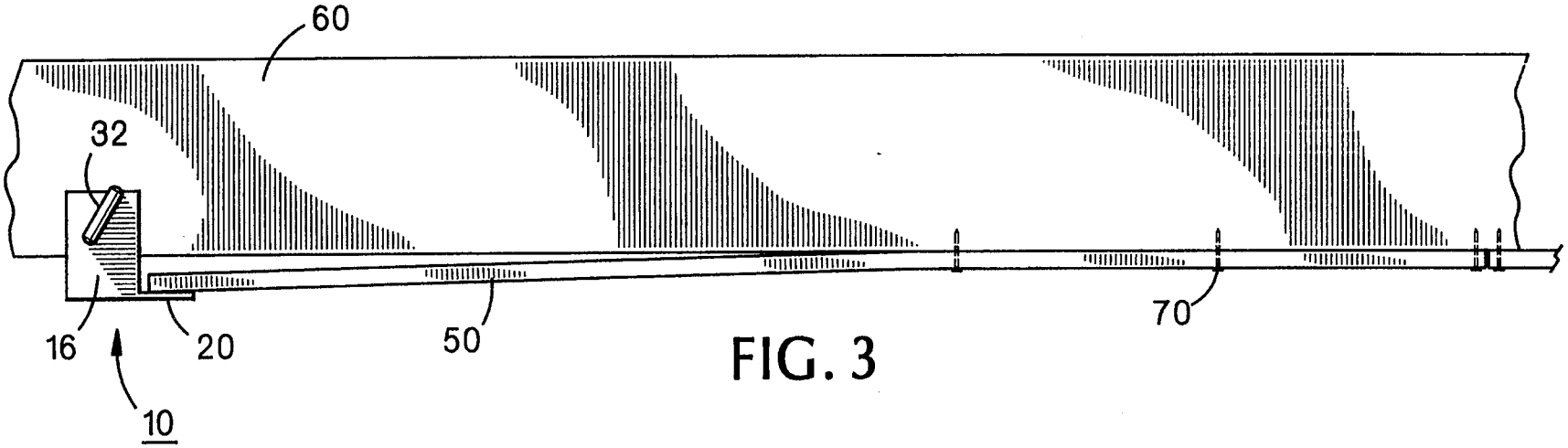
FIG. 3 is a side elevational view of the ceiling clamp of FIGS. 1 and 2 being employed to assist in installing a ceiling panel in one position.

FIG. 3 illustrates ceiling clamp 10 being employed to assist in mounting a ceiling panel 50 which may be assumed, for example, to be a sheetrock panel. Ceiling clamp 10 has been clamped to a ceiling joist 60 by fitting channel 12 (FIGS. 1 and 2) over the lower portion of the joist with the lower edge of the joist engaging the upper surface of floor 18, and then tightening washer 36 against the side of the joist by rotation of T-handle 32. Then a first end of panel 50 has been slid over the portion of base member 20 extending outwardly of the end of channel 12 such that ceiling clamp 10 is supporting that edge in proximity to joist 60. Then, a second, opposite end of panel 50 has been rotated upwardly against joist 60 and fastened thereto by means of nails, as at 70. When sufficient nails 70 have been driven through panel 50 into joist 60 to hold the panel in place, the T-handle 32 is loosened and ceiling clamp 10 is removed from the joist and the panel. Finishing of the fastening of panel 50 to joist 60 can then be completed.

Figure 4:
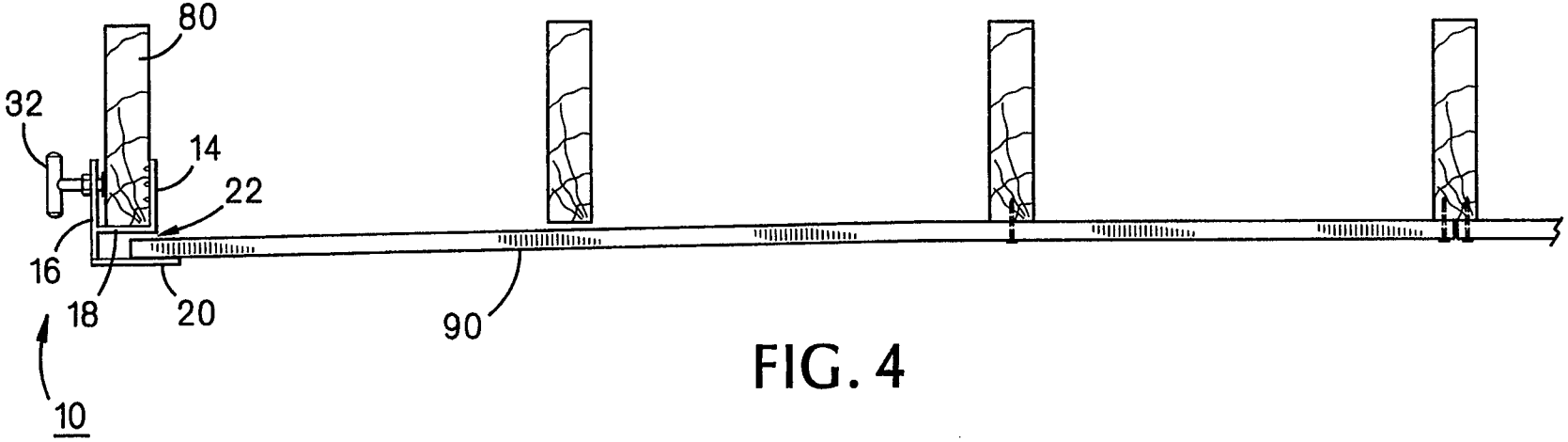
FIG. 4 is an end elevational view, partially in cross-section, of the ceiling clamp of FIGS. 1 and 2 being employed to assist in installing a ceiling panel in another position.

FIG. 4 illustrates ceiling clamp 10 clamped to a joist 80 and supporting a first edge of a ceiling panel 90. Here, panel 90 has been placed on the portion of base member 20 extending outwardly of distal wall 14 and into channel 22. Panel 90 is then secured the same as panel 50 on FIG. 3 and ceiling clamp 10 removed.

It can be seen, then, that ceiling clamp 10 may be employed to support either ends or edges of ceiling panels and, in neither case, is it required that the ceiling clamp be placed over the top of a ceiling joist.

Ceiling clamp 10 may be employed in a similar manner to assist in mounting building materials to wall studs or other structural framing.

Ceiling clamp 10 is preferably constructed from welded steel plate. Channel 12 will normally be dimensioned to clamp therein nominal 2-inch thick lumber and channel 22 will normally be dimensioned to accommodate therein up to ¾-inch thick panels. Should channel 12 be too wide to accommodate a structural member, the excess space can be compensated for by inserting a wood block in the channel.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A ceiling clamp to assist in mounting panels to a ceiling, comprising:

(a) an upwardly open channel defined by a distal vertical wall, an upper portion of a proximal vertical wall parallel to said distal vertical wall, and a horizontal floor joining said distal and proximal walls, said upwardly open channel being dimensioned to accommodate therein a lower portion of a ceiling joist;

(b) clamping means to clamp said lower portion of said ceiling joist in said upwardly open channel;

(c) a horizontal base member comprising a planar plate joined to a lower edge of said proximal wall of said upwardly open channel to provide a surface upon which an end or edge of ceiling panel may be placed when said ceiling clamp is clamped to said ceiling joist, said horizontal base member being parallel to, and spaced apart from, a lower surface of said floor, said base member, said floor, and a lower portion of said proximal wall defining a sidewardly open channel into which an end or edge of said ceiling panel may be inserted; and (d) said sidewardly open channel being smooth walled and with no additional members protruding into the space defined by contiguous inner surfaces of said base member, said floor, and said lower portion of said proximal wall.

2. A ceiling clamp, as defined in claim 1, wherein said horizontal base member extends horizontally outwardly of said clamp.

3. A ceiling clamp, as defined in claim 2, wherein said horizontal base member extends horizontally outwardly of said distal wall.

4. A ceiling clamp, as defined in claim 2, wherein said horizontal base member extends horizontally outwardly past said distal wall of said upwardly open channel.

5. A ceiling clamp, as defined in claim 1, wherein said clamping means comprises:

(a) a nut welded to an outer surface of said proximal wall;

(b) a T-handle having a threaded portion which threadingly engages said nut so as to advance said threaded portion through an opening defined through said proximal wall into said upwardly open channel; and (c) a washer welded to a distal end of said threaded portion of said T-handle extending into said upwardly open channel.

6. A ceiling clamp, as defined in claim 1, further comprising a plurality of sharp points extending into said upwardly open channel from an inner surface of said distal wall, said sharp points comprising tips of self-threading, self-tapping screws inserted through said distal wall.

* * * * *